US005832740A

United States Patent [19]

Gautiero

[11] Patent Number: 5,832,740

[45] Date of Patent: Nov. 10, 1998

[54] DOUBLE-CHAMBER HEAT EXCHANGER

[75] Inventor: Antonio Gautiero, Atripalda, Italy

[73] Assignee: Metalframe S.R.L., Milan, Italy

[21] Appl. No.: 788,133

[22] Filed: Jan. 24, 1997

[30] Foreign Application Priority Data

Jan. 26, 1996 [IT] Italy ..... NA96A0006

[51] Int. Cl.[6] ..... B08B 7/00; F25D 17/02

[52] U.S. Cl. ..... 62/374; 62/64; 134/9; 266/112

[58] Field of Search ..... 165/110 DC; 62/64, 62/374, 375, 373; 134/9; 266/112

[56] References Cited

U.S. PATENT DOCUMENTS 3,991,986 11/1976 Ward et al. ..... 266/112

5,329,779 7/1994 Lozano et al. .

*Primary Examiner*—William E. Wayner

*Attorney, Agent, or Firm*—Michael J. Striker

[57] ABSTRACT

A heat exchanger has an inner pipe inside of which a product travels, the inner pipe having a perforated lateral wall, an outer pipe surrounding the inner pipe and formed as a jacket, a plurality of flanges extending between the inner pipe and the outer pipe to form a plurality of segments, a plurality of supply passages each communicating with a segment of first group of segments for supplying a cooling liquid into a space between the outer pipe and the inner pipe, a plurality of discharge passage each communicating with one segment of a second group of the segments for discharging the cooling liquid from a space between the outer pipe and the inner pipe, each of the segments of the first group with which one of the supply passages is connected being located between two segments of the second group with which the discharge passages are connected.

10 Claims, 3 Drawing Sheets

DOUBLE-CHAMBER HEAT EXCHANGER

BACKGROUND OF THE INVENTION

The present invention relates generally to double-chamber heat exchangers.

More particularly, it relates to a double-chamber heat exchanger for rapid and high temperature jump particularly for cooling copper wire rods produced by continuous casting plants.

A cooling phase for lowering the temperature of the wire rod in order to make coil rolling possible follows the last rolling stand in continuous casting plants for the production of copper wire rods. Surface deoxidation of the wire rod also takes place during the same phase. Such procedure is presently carried out either by dipping of the wire rod into large basins or by making it travel along extended pipelines where it is cooled by liquids. In the latter case the length of the cooling and deoxidation is a function of the speed at which the wire rod travels, the temperature jump that must be obtained, and the type of the cooler used, as well as its pressure and the time it remains in contact with the wire rod:

Presently such plants have a cooling ramp with a pipe divided into segments by boxes draining the cooler which is run into the central part of each segment. Traveling inside the pipe, the wire rod is doused with the cooler, which partly goes to the nearest upstream box and partly is dragged by the speed of the wire rod to the nearest downstream box. Such a cooling process results however in a loss of a certain amount of Kcal/sec which, on the basis of observations and studies, in traditional heat exchangers proved to be limited by steam rising from the contact between the cooler and the wire rod, which reduces the efficiency rate of the heat exchange. This means that the heat loss is a function of the length of the relevant segment of the heat exchanger.

In order to increase the production of plants so built, it is necessary to increase their speed. In other words, the cooling plants should be adjusted only by increasing their length. Therefore an increase in production per hour can be obtained.

SUMMARY OF THE INVENTION

Accordingly, it is an object of present invention to provide a heat exchanger which is a substantial improvement of the existing heat exchangers.

More particularly, it is an object of present invention to provide a heat exchanger that remarkably increases a production speed in the above mentioned plans with simultaneous limiting the length of the heat exchange as well as the length of the segment to be cooled because of a greater efficiency of the heat exchange.

In keeping with these objects and with others which will become apparent hereinafter, one feature of the present invention resides, briefly stated in a heat exchanger for a copper wire rod produced by a rolling process after a continuous casting, which has a first pipe inside of which a wire rod travels and which is provided with a perforated lateral surface, and a second pipe formed as a jacket located outside of the first pipe, the second pipe being divided into a plurality of segments by flanges located at distances from one another and not connected to said first perforated pipe, and a pipe for cooler emission located between two adjacent flanges, wherein each segment is separated from the adjacent segment by a short piece to which a cooler discharge channel is connected.

When the heat exchanger is designed in accordance with the present invention, it avoids the disadvantages of the prior art and provides for the above mentioned highly advantageous results.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
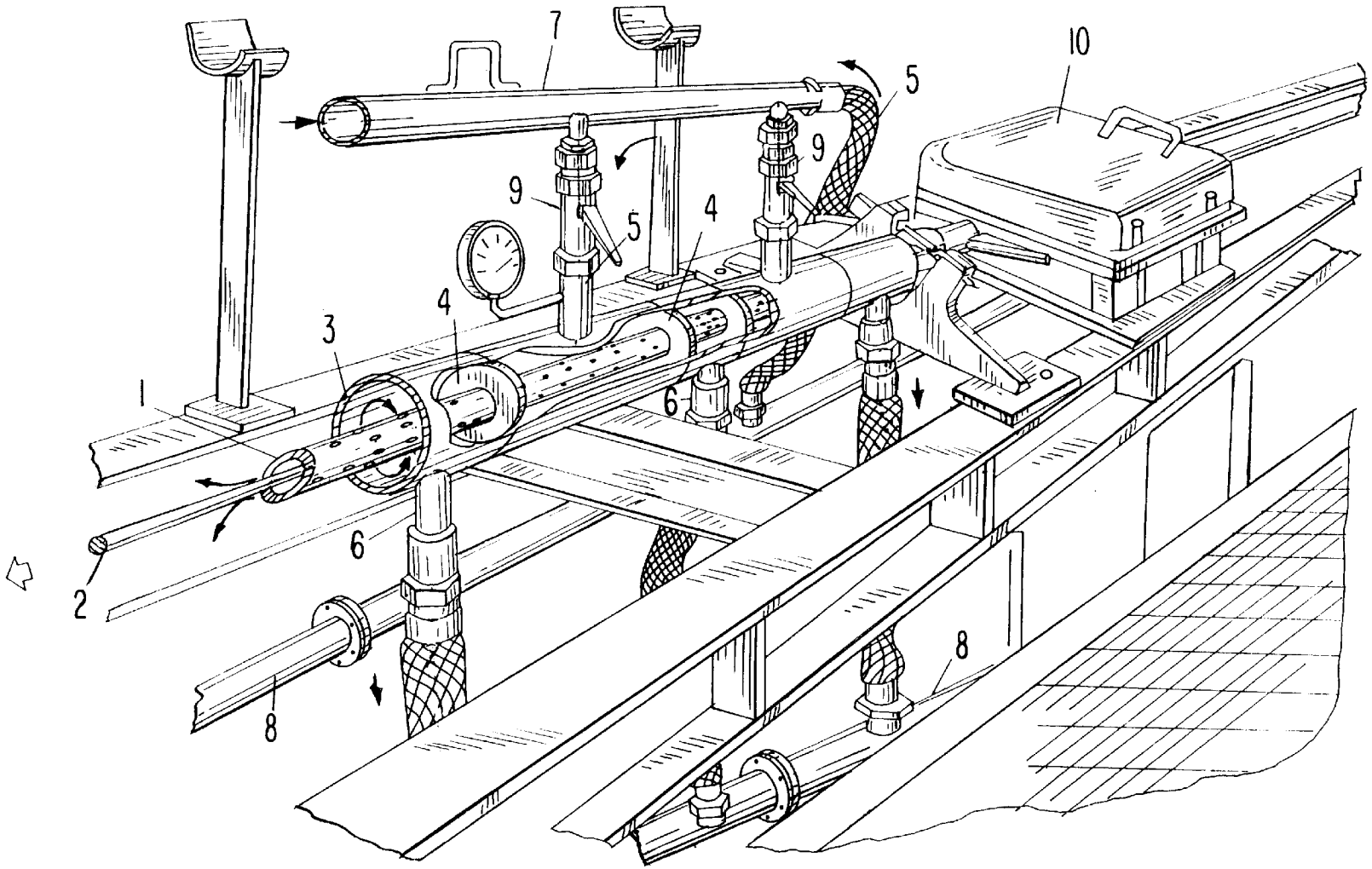
FIG. 1 is a perspective view showing a basic module of a cooling plant with a heat exchanger in accordance with the present invention.
Figure 2:
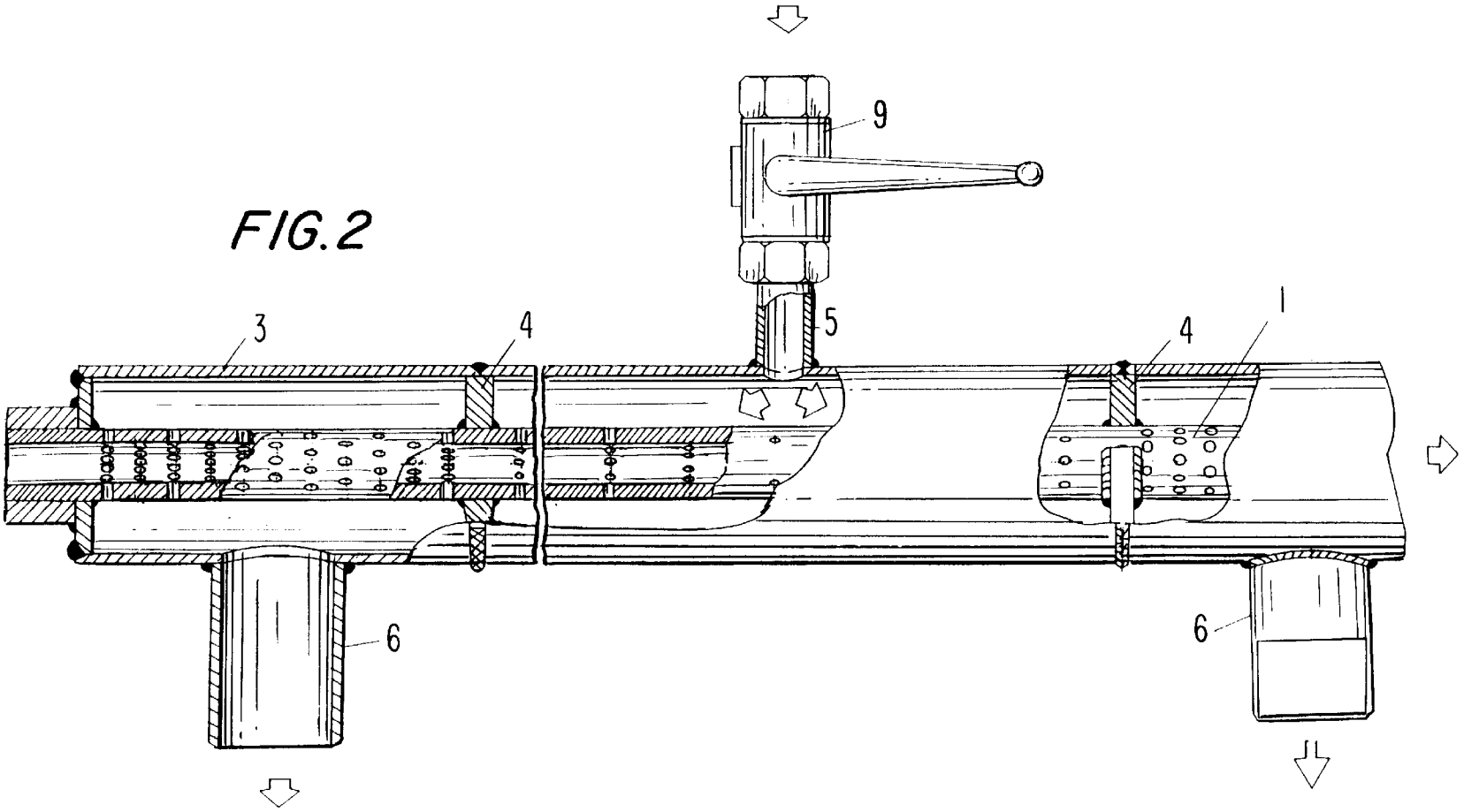
FIG. 2 is a view showing a vertical longitudinal section of the module with the inventive heat exchanger.
Figure 3:
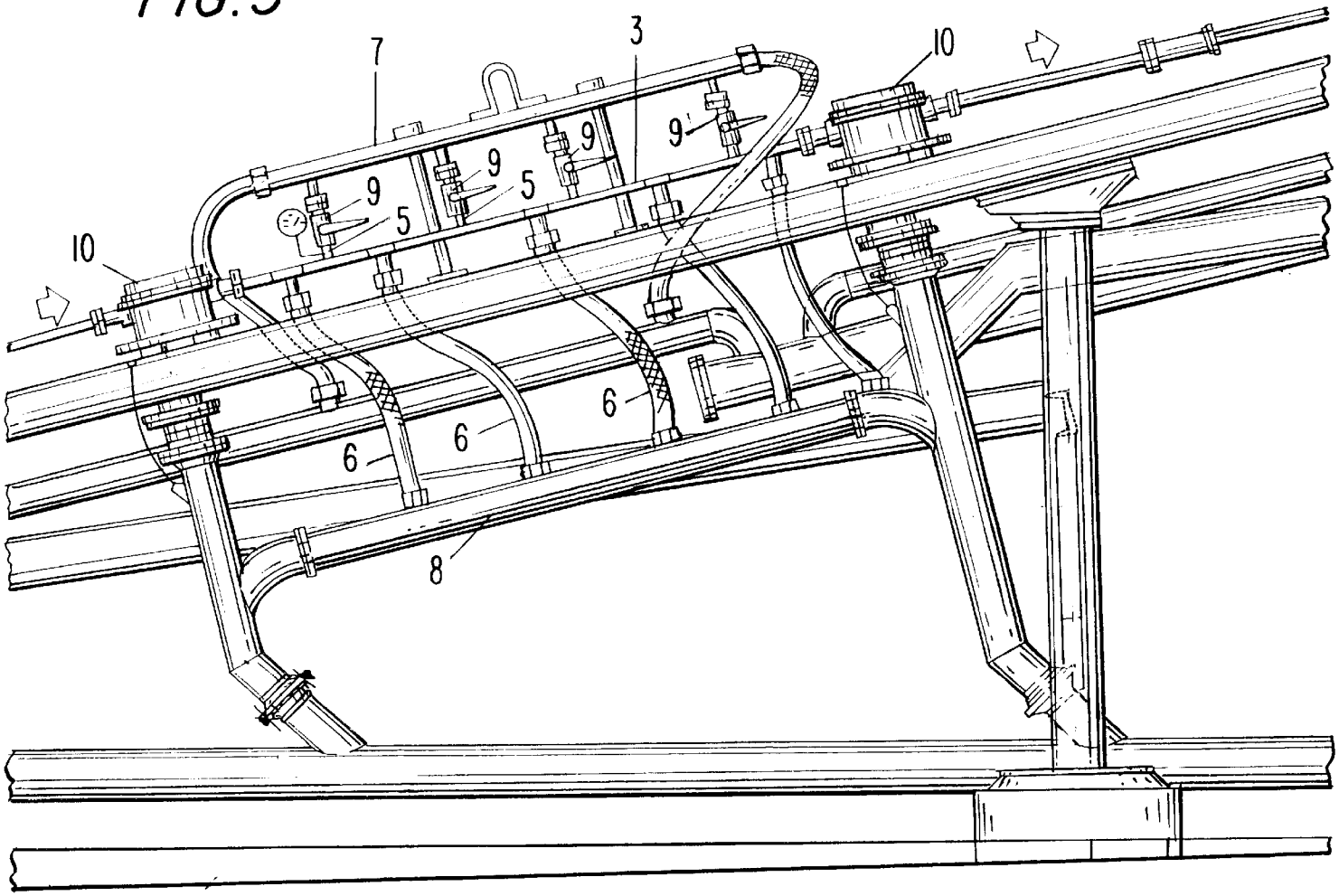
FIG. 3 is a view showing a plurality of modules arranged in series with segments between two inspection boxes.

A heat exchanger in accordance with the present invention has a first inner pipe which is identified with reference numeral 1. A wire rod 2 travels inside the pipe 1. The first inner pipe 1 has a perforated lateral wall and is surrounded by a second outer pipe 3 formed as a jacket. A space between the inner pipe 1 and the outer pipe 3 is divided by flanges 4 into a plurality of segments.

An emission inlet for a cooling liquid formed as a supply pipe is provided between the two adjacent flanges 4. In particular, an opening is formed in the outlet pipe 3, and the supply pipe 5 is connected with the openings. Drains 6 for withdrawing the cooling liquid formed as discharge pipes are provided at the beginning and at the end of each module of the heat exchanger. More particularly, an opening is formed in the outer pipe 3 in a segment between one flange and an adjacent flange 4, and the discharge pipe 6 is connected with the opening.

A supply manifold 7 is connected with the supply pipes 5, while a discharge manifold 8 is connected with the discharge pipes 6. Valves 9 are associated with the supply pipes 5 for controlling the supply of the cooling liquid.

Inspection boxes 10 are provided upstream and downstream of each module. Also, a further drain or discharge pipe can be provided for the cooling liquid that fails to reach the other drains or the discharge pipes 6. The further drains are located in the inspection boxes 10.

The heat exchanger in accordance with the present invention operates in the following manner.

The cooling liquid comes from the manifold 7 and passes through the valves 9 into the segments formed between the flanges 4, the inner pipe 1 and the outer pipe 3, then it douses the wire rod 2 through the perforated lateral wall surface of the inner pipe 1 so as to highly cool the wire rod, and finally the liquid is drained mainly through the discharge pipes 6. The remainder of the liquid is drained through the drains located in the inspection boxes 10.

In the heat exchanger in accordance with the present invention the liquid is distributed through very close points, and then it is forced through in a very restricted area, before being drained through the very close discharge pipes. Therefore, liquid actually remains in contact with the wire rod for a very short period of time. In this way, the period of time during which the cooling liquid is in touch with the hot wire rod is highly reduced, the rise in temperature is limited to a minimum, and steam formation deriving from contact is avoided. In contrast, in traditional heat exchangers the steam formation causes remarkable reduction in heat exchange efficiency.

The valves 9 on the supply pipes 5 provide for a fine adjustment of the cooling rate, piloting the temperature jump speed and the temperature of the material in every segment, so that the crystalline structure of the product can receive the characteristics which are appropriate for the specific application. In the inventive heat exchanger with the speed of travel of the wire rod being equal, the reduction of length of the cooling plant is to provided. On the other hand, if the length of the cooling plant is equal, a remarkable increase in production per hour is obtained. The inventive heat exchanger reduces the delay of time during which the cooling liquid remains in contact with the wire rod and rapidly recycles it, carrying out a better deoxidation of the product with a corresponding quality increase.

While the inventive heat exchanger has been conceived to obtain a rapid cooling of the copper wire rod produced by continuous casting plants, it can be suitably adjusted to cool other metallic products, alloys and similar products deriving from continuous castings.

It will be understood that each of the elements described above, or two or more together, may also find a useful application in other types of constructions differing from the types described above.

While the invention has been illustrated and described as embodied in double-changer heat exchanger, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat exchanger, comprising an inner pipe inside of which a product travels, said inner pipe having a perforated lateral wall; an outer pipe surrounding said inner pipe and formed as a jacket; a plurality of flanges extending between said inner pipe and said outer pipe to form a plurality of segments; a plurality of supply passages each communicating with a segment of first group of segments for supplying a cooling liquid into a space between said outer pipe and said inner pipe; a plurality of discharge passages each communicating with one segment of a second group of said segments for discharging the cooling liquid from a space between said outer pipe and said inner pipe, each of said segments of said first group with which one of said supply passages is connected being located between two segments of said second group with which said discharge passages are connected.

2. A heat exchanger as defined in claim 1, wherein said perforated wall of said inner pipe has an inner surface for guiding a product which travels inside said inner pipe.

3. A heat exchanger as defined in claim 1, wherein said supply passages are formed as short pipes connected with said outer pipe and communicating a space between said inner and outer pipe with a source of the cooling liquid.

4. A heat exchanger as defined in claim 1, wherein said discharge passages are formed as short pipes connected with said outer pipe and communicating a space between said inner pipe and said outer pipe with outside.

5. A heat exchanger as defined in claim 1, wherein said flanges are connected with said inner pipe.

6. A heat exchanger as defined in claim 1, wherein said segments with which said discharge passages are connected are shorter than said segments with which said supply passages are connected.

7. A heat exchanger as defined in claim 1; and further comprising a valve associated with each of said supply passages and controlling a cooling fluid supply through said supply passages.

8. A heat exchanger as defined in claim 1; and further comprising inspection boxes extending through said perforated wall of said inner pipe.

9. A heat exchanger as defined in claim 1; and further comprising additional drains for draining the cooling fluid which does not reach said discharge passages.

10. A heat exchanger as defined in claim 8; and further comprising additional drains for draining the cooling fluid which does not reach said discharge passages, said additional drains being provided in said inspection boxes.

* * * * *